US006415534B1

(12) United States Patent
Liao

(10) Patent No.: US 6,415,534 B1
(45) Date of Patent: Jul. 9, 2002

(54) FLUID DECORATIVE STRUCTURE

(76) Inventor: Chu-Yuan Liao, 5F-1, No. 177, Sec. 1 Ho-Ping E. Rd., Taipei (TW)

( * ) Notice: Subject to any disclaimer, the term of this patent is extended or adjusted under 35 U.S.C. 154(b) by 79 days.

(21) Appl. No.: 09/651,738

(22) Filed: Aug. 30, 2000

(51) Int. Cl.[7] ..... G09F 19/00
(52) U.S. Cl. ..... 40/407; 428/900; 446/267
(58) Field of Search ..... 428/900; 40/407, 40/406; 446/267

*Primary Examiner*—Alexander S. Thomas
(74) *Attorney, Agent, or Firm*—Troxell Law Office PLLC

(57) ABSTRACT

Fluid decorative structure including an enclosing body and a scat body. The enclosing body is made of a very soft transparent or semitransparent material and formed with an opening at bottom end. Fluids with different colors and specific weights are filled into the enclosing body. An insertion member has a patterned article and an ejecting device. The ejecting device is composed of a tube body and a piston disposed in the tube body. When a rotary disc is rotated and a first magnetic member is moved to a position right under a second magnetic member, the first magnetic member will repel the second magnetic member to make the piston periodically move upward within the tube body so as to eject the second fluid with the heavier specific weight from the spout of the tube body.

7 Claims, 4 Drawing Sheets

FLUID DECORATIVE STRUCTURE

BACKGROUND OF THE INVENTION

The present invention relates to a fluid decorative structure, and more particularly to a fluid decorative structure in which two different fluids with different colors and specific weights and a patterned article are contained in the enclosing body. A piston is disposed in the patterned article and driven by magnetic repelling force. By means of magnetic repulsion, the piston is periodically driven to move upward within the patterned article so as to eject the second fluid with heavier specific weight from patterned article and then pump the second fluid into the patterned article. Therefore, a colorful dynamic view is presented by the fluid decorative structure.

A conventional fluid decorative structure is rested on a desk or placed indoors to achieve a decorative effect. Such conventional fluid decorative structure has a hard transparent housing (made of glass or other transparent hard materials). A fluid and decorative articles (such as ships, fishes, etc.) are contained in the housing. The housing is seated on a seat body to form the fluid decorative structure. Such fluid decorative structure can only present a static view for watching and only when manually applying an external force to shake the fluid decorative structure, the internal decorative articles can present a dynamic view. Without the external force, the decorative articles will keep still and present a monotonous visual decorative effect. Moreover, the housing of the decorative structure is made of hard material so that in case of dropping, the housing may be broken and the fluid and decorative articles as well as the hard fragments of the housing will scatter around. Therefore, it is necessary to develop an improved fluid decorative structure which can present dynamic view without manual operation and is not subject to breakage.

SUMMARY OF THE INVENTION

It is therefore a primary object of the present invention to provide a fluid decorative structure including a transparent soft enclosing body and a seat body. A first and a second fluids with As different colors and specific weights are filled into the enclosing body. An insertion member is enclosed in the bottom end of the enclosing body. A patterned article is disposed on the insertion member. The insertion member enclosed in the lower end of the enclosing body is inlaid in an insertion section of top end of the seat body to associate the enclosing body with the seat body. A rotary disc driven by a gear case is disposed in the seat body. At least one magnetic member is disposed at an eccentric portion of the rotary disc. An ejecting device is received in the patterned article and driven by magnetic repelling force. When the rotary disc is rotated, by means of magnetic repulsion, the magnetic member of the rotary disc will drive the ejecting device to upward eject the second fluid with heavier specific weight out of the patterned article. The second fluid then gradually falls as to create a colorful dynamic view.

It is a further object of the present invention to provide the above fluid decorative structure in which the enclosing body is made of very soft and elastic material and is retained on the seat body. Therefore, a user not only can watch the patterned article enclosed in the enclosing body, but also can squeeze the enclosing body to indirectly touch the patterned article through the enclosing body. Therefore, another type of entertaining effect can be achieved. Moreover, in case of accidental dropping, the soft enclosing body provides a buffering effect to protect the fluid decorative structure from breaking.

The present invention can be best understood through the following description and accompanying drawings wherein:

DETAILED DESCRIPTION OF THE PREFERRED EMBODIMENT

Figure 1:
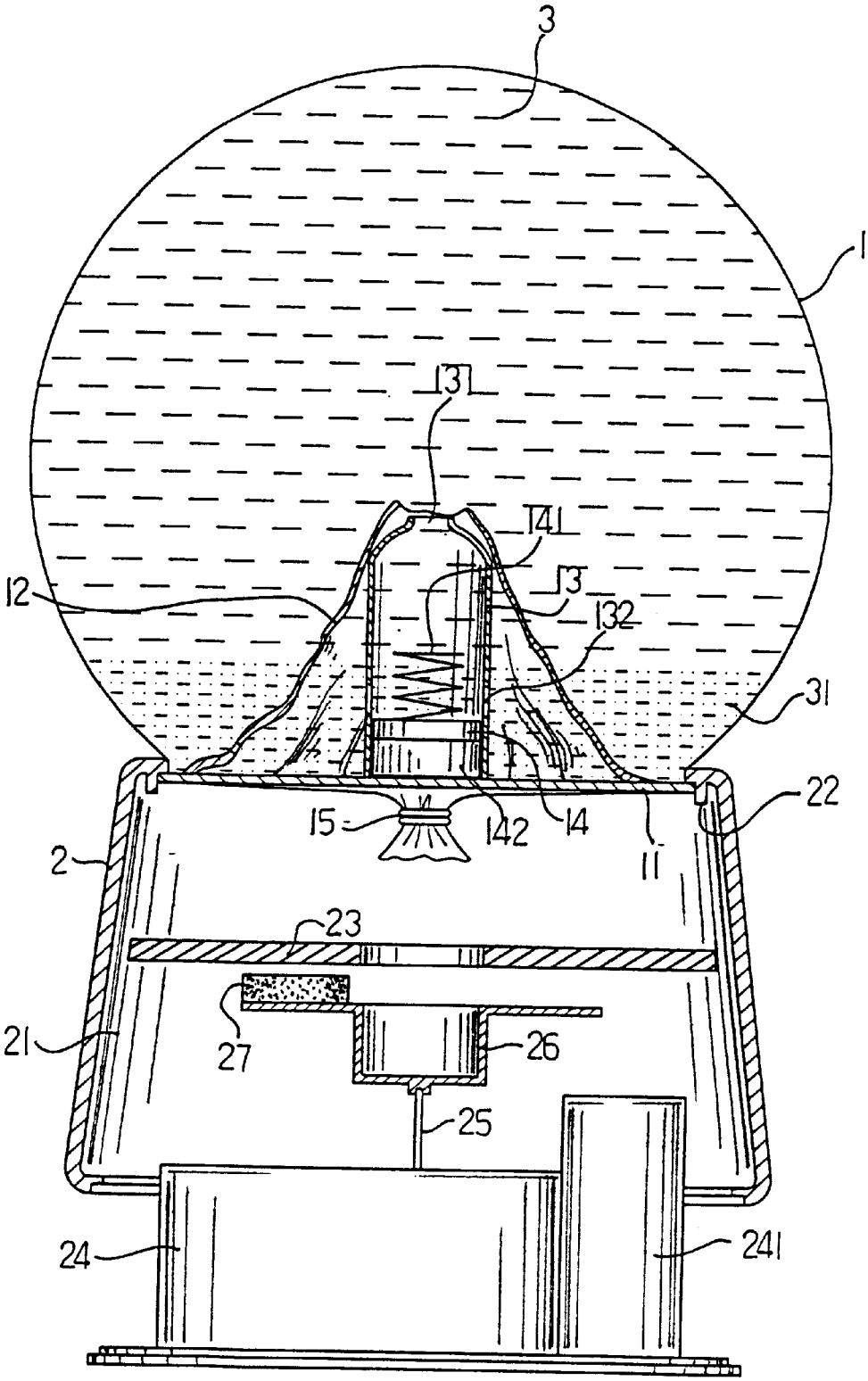
FIG. 1 is a plane sectional exploded view of the fluid decorative structure of the present invention.
Figure 2:
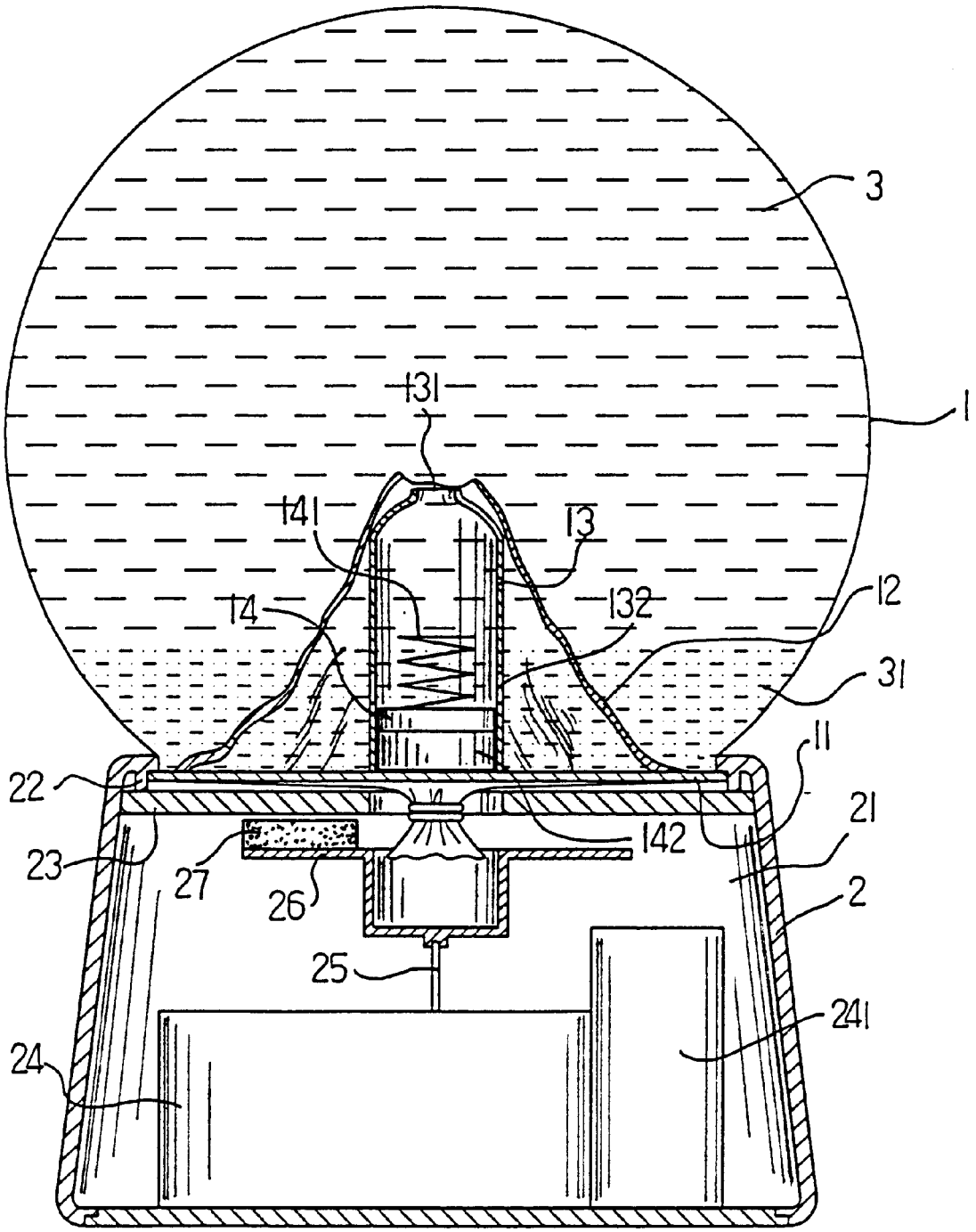
FIG. 2 is a plane sectional assembled view of the fluid decorative structure of the present invention.
Figure 3:
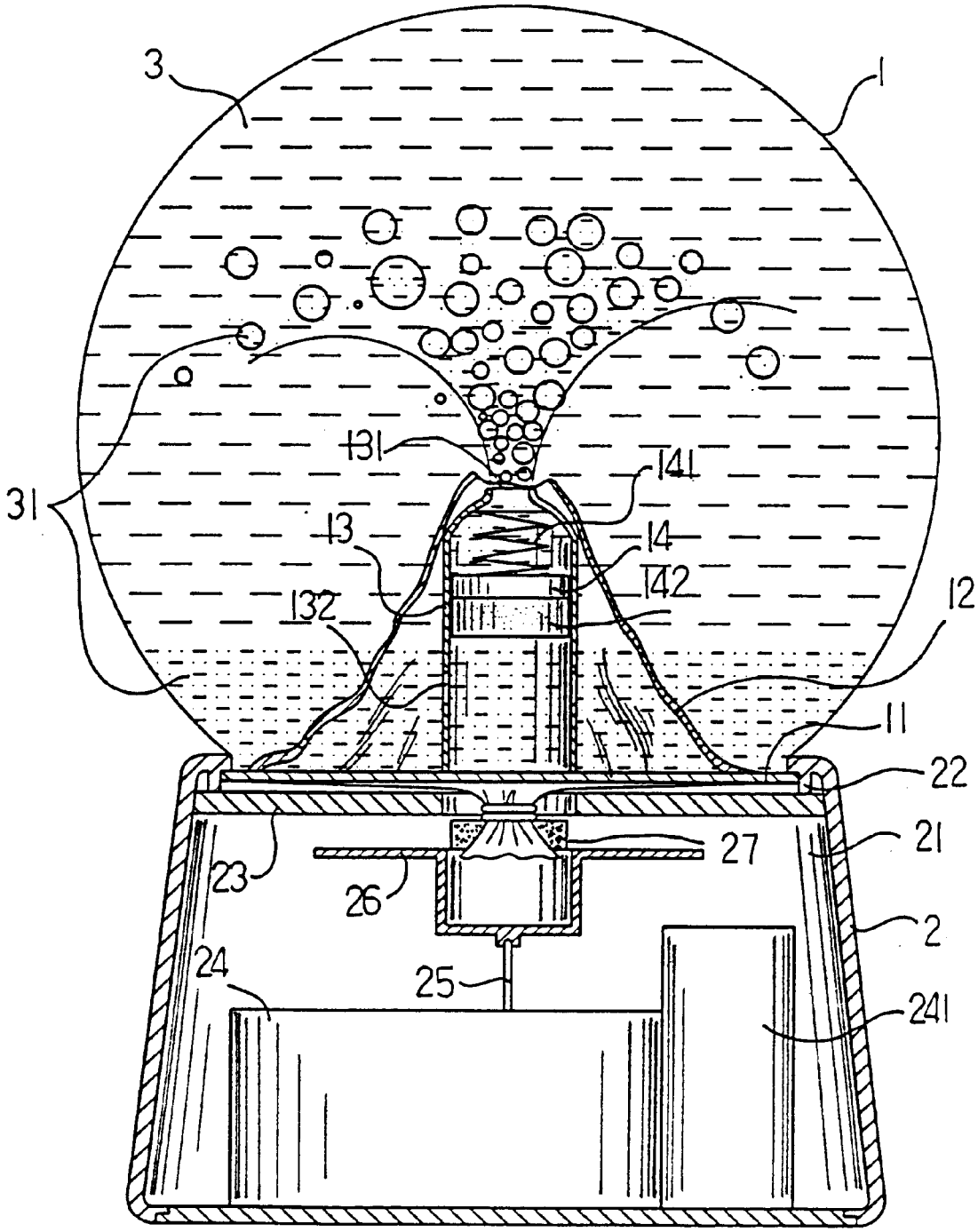
FIG. 3 shows the operation of the fluid decorative structure of the present invention.
Figure 4:
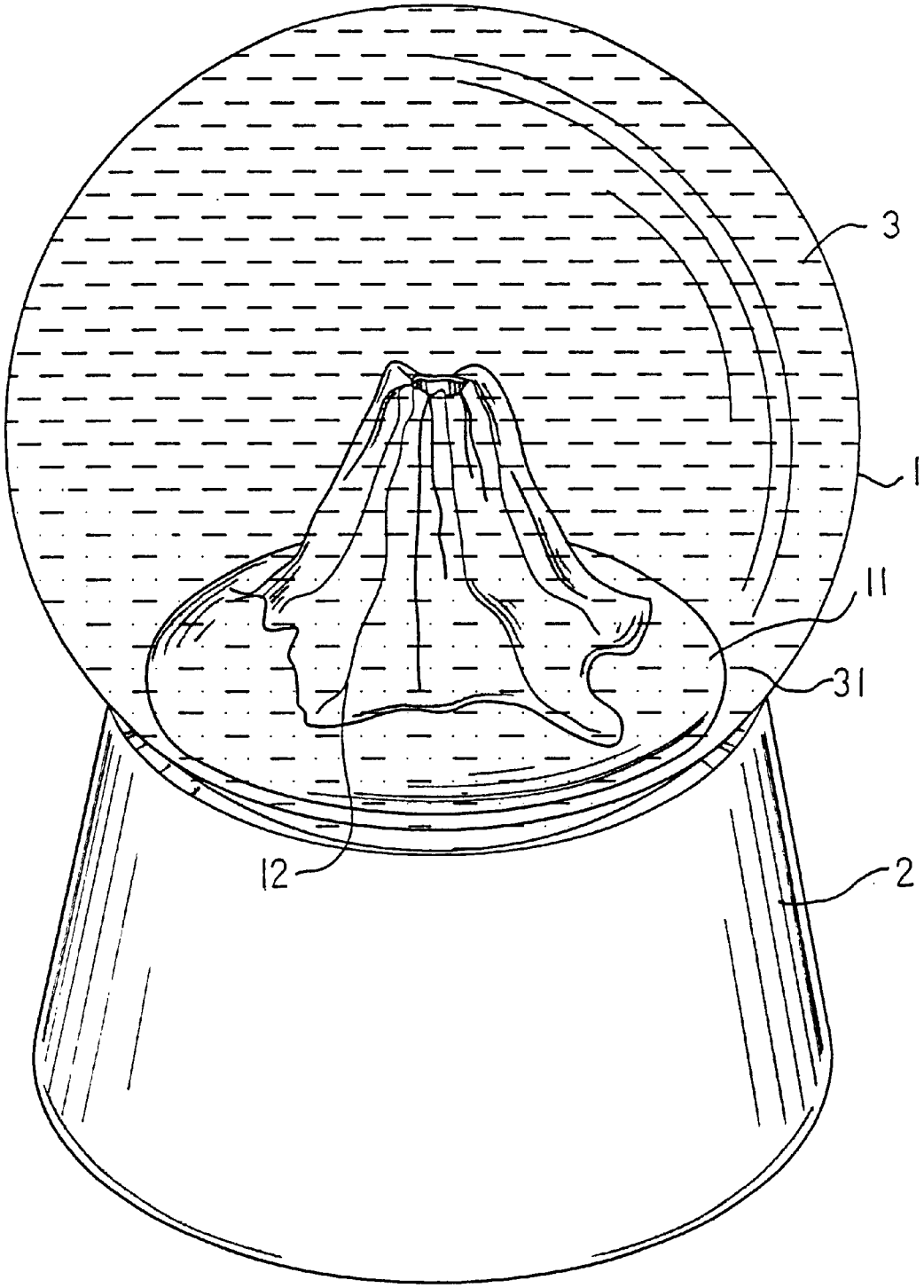
FIG. 4 is a perspective view of the appearance of the fluid decorative structure of the present invention.

Please refer to FIGS. 1, 2 and 4. The fluid decorative structure of the present invention includes a transparent or semitransparent enclosing body 1 and a seat body 2. The enclosing body 1 is made of very soft material and formed with an opening at one end. A first and a second fluids 3, 31 with different colors and specific weights are filled into the enclosing body 1. An insertion member 11 is placed in the enclosing body 1. A patterned article 12 is disposed on the insertion member 11. A tube body 13 is received in the patterned article 12. A reciprocally slidable piston 14 is disposed in the tube body 13. The upper end of the tube body 13 is formed with a spout 131. In addition, at least one through hole 132 is formed on the circumference of the tube body 13 near bottom end thereof. A resilient member 141 is disposed at upper end of the piston 14 and a magnetic member 142 is connected with lower end of the piston 14.

The seat body 2 is formed with an interior receiving chamber 21 having an opening on top side. An inward projecting annular insertion section 22 is formed along inner circumference of the opening. The insertion member 11 enclosed in the enclosing body 1 is inlaid in the insertion section 22. A preset fixing member 23 is upward engaged under the insertion section 22, whereby the open end or bottom end of the enclosing body 1 is converged and retained between the insertion member 11 and the fixing member 23. The open end is further tied up or sealed by a sealing material into a tied section 15. A gear case 24 is disposed in the receiving chamber 21 of the seat body 2 under the fixing member 23 and driven by a preset power source 241. The gear case 24 via a transmission shaft 25 drives a rotary disc 26 to rotate. At least one magnetic member 27 is disposed at an eccentric portion of the rotary disc 26 corresponding to the magnetic member 142 of the lower end of the piston 14. When the rotary disc 26 is rotated, the magnetic member 27 moves in a path passing through a position right under the tube body 13 or the magnetic member 142.

Referring to FIG. 2, when the power source 241 drives the gear case 24 to make the transmission shaft 25 rotarily drive the rotary disc 26 and when the magnetic member 27 moves to the position under the tube body 13, by means of magnetic repulsion, the magnetic member 27 will repel the magnetic member 142 to make the piston 14 move upward. Under such circumstance, a part of the second fluid 31 with heavier specific weight in the tube body 13 above the piston 14 will be abruptly urged to move upward and then ejected from the spout 131. The second fluid 31 due to heavier specific weight will then gradually scatter and fall. During the upward movement of the piston 14, the resilient member 141 is compressed to reserve a certain resiliently restoring energy.

When the magnetic member 27 is turned away from the tube body 13, the resilient member 141 resiliently downward pushes and gradually restores the piston 14 back to its home position. At this time, the second fluid 31 can naturally flow through the through hole 132 into the space in the tube body 13 above the piston 14. Accordingly, by means of repeated operation, the piston 14 will periodically eject the second fluid 31 from the spout 131 so as to present a dynamic view. In cooperation with the patterned article 12, the fluid decorative structure is able to achieve a greatly enhanced visual decorative and entertaining effect. In addition, the enclosing body 1 of the fluid decorative structure is made of very soft and elastic material so that a user not only can watch the decorative article enclosed in the enclosing body, but also can indirectly touch the patterned article 12 through the enclosing body. Therefore, another type of entertaining effect can be achieved. Moreover, in case of accidental dropping, the soft enclosing body 1 provides a buffering effect to protect the fluid decorative structure from breaking.

The above embodiment is only used to illustrate the present invention, not intended to limit the scope thereof. Many modifications of the above embodiment can be made without departing from the spirit of the present invention.

What is claimed is:

1. Fluid decorative structure comprising an enclosing body and a seat body, the enclosing body being made of a transparent material as an envelope formed with an opening at bottom end, a first and a second fluids with different colors and specific weights being filled into the enclosing body, an insertion member being placed in the bottom end of the enclosing body, a patterned article being disposed on the insertion member, a tube body being received in the patterned article, a top end of each of the tube body and the patterned article being formed with at least one spout, at least one through hole being formed on the circumference of the tube body near bottom end thereof, a piston being disposed in the tube body, a magnetic member being disposed under the piston, the seat body being formed with an interior receiving chamber having an opening on top end, an annular insertion section being formed along inner circumference of the opening, the insertion member enclosed in the enclosing body being inlaid in the insertion section, a gear case being disposed in the receiving chamber of the seat body and driven by a power source, at least one magnetic member being disposed on the rotary disc, whereby when the rotary disc is rotated, the magnetic member moves in a path passing through a position right under the tube body and by means of magnetic repulsion, the magnetic member will repel the magnetic member under the piston to make the piston periodically move upward within the tube body so as to push and eject a part of the second fluid with heavier specific weight in the tube body from the spout.

2. Fluid decorative structure as claimed in claim 1, wherein a resilient member is disposed on upper side of the piston for downward pushing and restoring the piston to its home position.

3. Fluid decorative structure as claimed in claim 2, wherein a fixing member is upward engaged under the insertion section of the seat body so as to sealedly cover and retain the lower end of the enclosing body enclosing the insertion member.

4. Fluid decorative structure as claimed in claim 1, wherein the enclosing body is made of soft and elastic material.

5. Fluid decorative structure as claimed in claim 1, wherein the lower end of the enclosing body has an opening, the lower open end of the enclosing body being downward passed through the opening of the top end of the seat body and then enclosing the insertion member, then the open end being converged and tied up under the insertion member.

6. Fluid decorative structure as claimed in claim 1, wherein a fixing member is upward engaged under the insertion section of the seat body so as to sealedly cover and retain the lower end of the enclosing body enclosing the insertion member.

7. Fluid decorative structure as claimed in claim 1, wherein the power source via a gear case indirectly drives the rotary disc.

* * * * *